United States Patent [19]

Parise et al.

[11] 4,075,733

[45] Feb. 28, 1978

[54] CLEANING HEAD

[75] Inventors: Carl Parise, Reno; James M. Wimsatt, Carson City, both of Nev.

[73] Assignee: Parise & Sons, Inc., Reno, Nev.

[21] Appl. No.: 674,696

[22] Filed: Apr. 7, 1976

[51] Int. Cl.[2] ..... A47L 7/00

[52] U.S. Cl. ..... 15/322; 239/164; 239/176

[58] Field of Search ..... 15/50 R, 302, 320, 321, 15/322; 239/164, 176

[56] References Cited

U.S. PATENT DOCUMENTS

| | | | |
|---|---|---|---|
| 3,202,359 | 8/1965 | Gill, Jr. | 239/176 X |
| 3,402,420 | 9/1968 | Schaeffer | 15/320 |
| 3,663,984 | 5/1972 | Anthony et al. | 15/321 |
| 3,705,437 | 12/1972 | Rukavina, Jr., et al. | 15/302 |
| 3,747,155 | 7/1973 | Koellisch | 15/322 |
| 3,896,521 | 7/1975 | Parise | 15/322 X |
| 3,902,666 | 9/1975 | Ito et al. | 239/176 X |

*Primary Examiner*—Christopher K. Moore
*Attorney, Agent, or Firm*—Sughrue, Rothwell, Mion, Zinn and Macpeak

[57] ABSTRACT

The specification discloses an improvement in a cleaning head for a hot water extraction system of the type which comprises walls defining a vacuum chamber one side of which is open to the exterior and means for spraying a jet of atomized hot water against the plane of the open side of the vacuum chamber. The improvement comprises means for varying the area of impact of the jet of atomized hot water on that plane. In the preferred embodiment disclosed herein, the spray means is mounted on one of the walls by means of two screws which pass through slots in the spray means and thread into the wall, thereby permitting the distance of the spray means from the plane to be varied.

1 Claim, 5 Drawing Figures

CLEANING HEAD

FIELD OF THE INVENTION

This invention relates to a hot water extraction system for cleaning carpets and the like. Such devices are commonly, but inaccurately, referred to as steam cleaners. In particular, this invention is an improved cleaning head for such a device.

OBJECT OF THE INVENTION

In hot water extraction systems, a cleaning solution composed of hot water mixed with detergents and/or other chemicals is sprayed on the object to be cleaned, after which the cleaning solution and entrained dirt is drawn off the object to be cleaned by a vacuum. As more cleaning chemical is added to the liquid, the wetability of the solution increases, thus producing a larger spray area. It is an object of this invention to control the spray area by providing means for lowering and raising the spring nozzle relative to the object to be cleaned. It is a further object of this invention to allow the amount of cleaning solution per unit area the cleaning head sprays on the object to be cleaned to be easily varied by the user of a hot water extraction system incorporating this invention.

SUMMARY OF THE INVENTION

The invention comprises means for varying the area of impact of the jet of atomized hot water on the object to be cleaned. In the preferred embodiment disclosed herein, the spray means is mounted on one of the walls by means of two screws which pass through slots in the spray means and thread into the wall, thereby permitting the distance of the spray means from the object to be cleaned to be varied.

DETAILED DESCRIPTION OF THE PREFERRED EMBODIMENT

Figure 1:
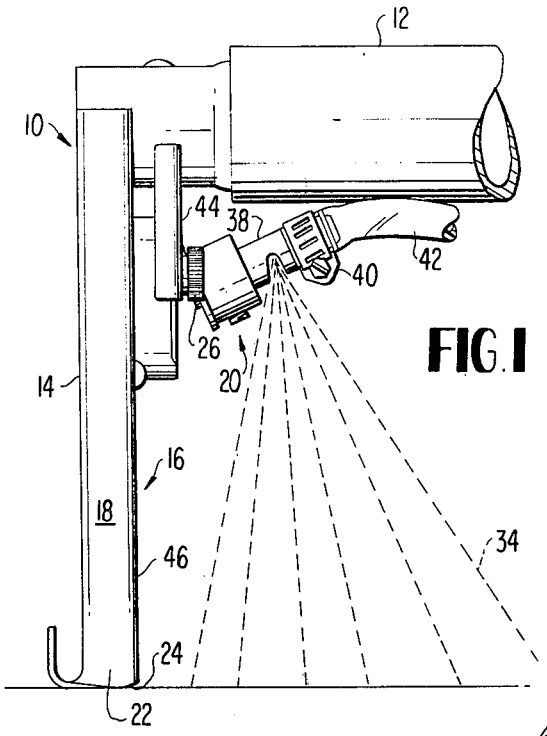
FIG. 1 is a side view of the preferred embodiment of the present invention with the spray means set at one extreme.
Figure 2:
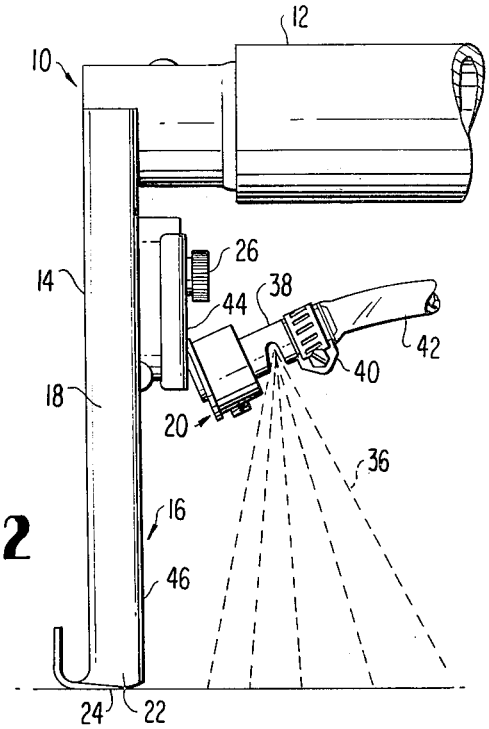
FIG. 2 is a side view of the embodiment shown in FIG. 1 with the spray means set at the opposite extreme.
Figure 3:
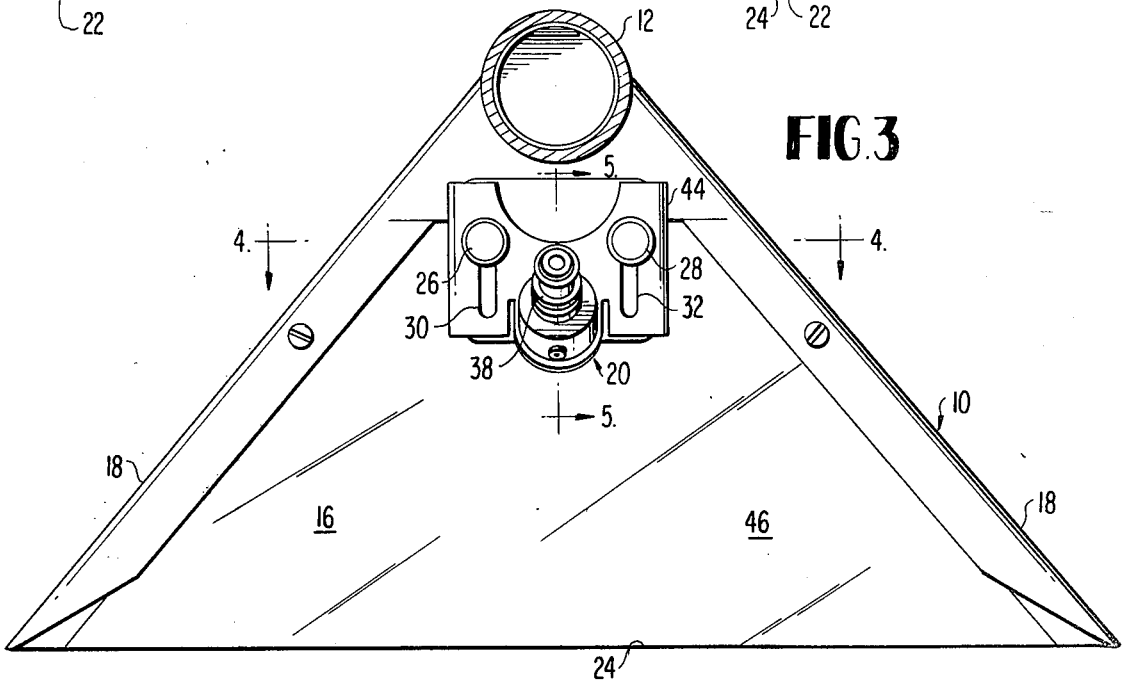
FIG. 3 is a front view of the embodiment shown in FIG. 1.
Figure 4:
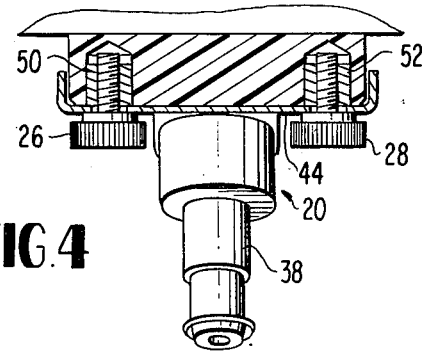
FIG. 4 is a view along lines 4—4 in FIG. 3.

FIGS. 1–3 show a cleaning head 10 according to the present invention attached to a vacuum wand 12, which is in turn connected to the remainder of a hot water extraction system — as shown, for example, in commonly assigned U.S. Pat. No. 3,896,521, issued July 29, 1975. The cleaning head 10 comprises a bottom wall 14, a top wall 16, side walls 18, and spray means 20. The walls 14, 16, and 18 define a vacuum chamber 22 one side 24 of which is open to the exterior, and the spray means 20 is positioned so that, during use of the cleaning head 10, it will spray a jet of atomized hot water against the plane of the open side 24 of the vacuum chamber 22. Of course, during use of the cleaning head 10, that plane will normally coincide with the surface of an object being cleaned, such as a carpet.

So far the description has described only what is conventional in the art. The present invention, however, comprises means for varying the area of impact of the jet of atomized hot water on the plane of the open side 24 of the vacuum chamber 22. In particular, the preferred embodiment of the invention depicted in the drawings comprises means for varying the distance of the spray means 20 from the plane of the open side 24 of the vacuum chamber 22. In order to accomplish this variation, the spray means 20 is mounted on the wall 16 by means of two screws 26 and 28 which pass respectively through slots 30 and 32 in the spray means 20 and thread into the wall 16. As shown, the major axes of the slots 30 and 32 are perpendicular to the plane of the open side 24 of the vacuum chamber 22, thereby permitting the distance of the spray means 20 from that plane to be varied between the maximum shown in FIG. 1 and the minimum shown in FIG. 2. Since the spray means 20 itself is not affected in the preferred embodiment, it is obvious that the area of impact of the jet of atomized hot water symbolized by the dashed lines 34 on that plane in FIG. 1 is much greater than the area of impact of the jet of atomized hot water symbolized by the dashed lines 36 on that plane in FIG. 2.

Figure 5:
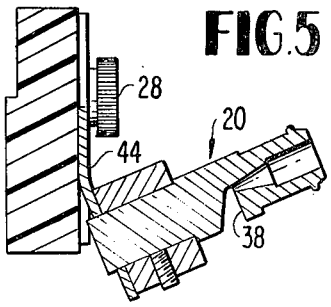
FIG. 5 is a view along lines 5—5 in FIG. 3.

In the preferred embodiment depicted in the drawings, the spray means 20 comprises a nozzle 38 (best seen in FIG. 5), a clamp 40 for attaching a hot water lead line 42 to the nozzle 38, and a mounting flange 44 which contains the slots 30 and 32. However, it is obvious that the subject invention is not limited to any particular configuration of the spray means 20. Similarly, in the preferred embodiment depicted in the drawings, the top wall 16 comprises a flat portion 46 made of a transparent plastic and a plastic mounting block 48 which contains internally threaded inserts 50 and 52 which are glued or press fit into the mounting block 48 and which receive the screws 26 and 28, respectively. However, it is likewise obvious that the subject invention is not limited to any particular configuration of the top wall 16.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. In a cleaning head for a hot water extraction system which comprises:

(a) walls defining a vacuum chamber one side of which is open to the exterior and (b) means for spraying a jet of atomized hot water against the plane defined by the open side of the vacuum chamber defined by said walls, the improvement wherein said means is mounted on one of said walls by means of two screws which pass through slots in said means and thread into one of said walls, the major axes of said slots being perpendicular to the plane defined by the open side of the vacuum chamber defined by said walls, whereby the distance of said means from the plane defined by the open side of the vacuum chamber defined by said walls can be varied, thereby varying the area of impact of the jet of atomized hot water on the plane defined by the open side of the vacuum chamber defined by said walls.

* * * * *